US006730412B2

(12) United States Patent
Kono et al.

(10) Patent No.: US 6,730,412 B2
(45) Date of Patent: May 4, 2004

(54) METAL MATRIX COMPOSITE

(75) Inventors: Akira Kono, Nagoya (JP); Takeshi Yamada, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/274,101

(22) Filed: Oct. 21, 2002

(65) Prior Publication Data

US 2003/0082397 A1 May 1, 2003

(30) Foreign Application Priority Data

Oct. 29, 2001 (JP) ..... 2001-330780

(51) Int. Cl.[7] ..... B32B 5/12; B32B 7/04; B32B 15/14

(52) U.S. Cl. ..... 428/608; 428/611; 428/614; 428/293.1

(58) Field of Search ..... 428/608, 611, 428/614, 293.1

(56) References Cited

U.S. PATENT DOCUMENTS 4,779,563 A * 10/1988 Ishikawa et al. ..... 118/612
5,143,312 A * 9/1992 Baurmeister ..... 242/444
5,405,571 A * 4/1995 Truckner et al. ..... 419/8
5,579,532 A * 11/1996 Edd ..... 419/2
5,624,516 A * 4/1997 Hanusiak et al. ..... 156/173
5,695,847 A * 12/1997 Browne ..... 428/112
6,284,089 B1 * 9/2001 Anderson et al. ..... 156/304.3
6,303,095 B1 * 10/2001 Nishimura et al. ..... 423/447.2

FOREIGN PATENT DOCUMENTS

JP 9-278237 10/1997

* cited by examiner

*Primary Examiner*—Deborah Jones
*Assistant Examiner*—Jason Savage
(74) *Attorney, Agent, or Firm*—Oblon, Spivak, McClelland, Maier & Neustadt, P.C.

(57) ABSTRACT

The present invention provides a metal matrix composite having stable performance without extremely weak portions and capable of assuring strength with a simple structure, the metal matrix composite being formed by hot-pressing or hot-isostatic-pressing a flat formation of reinforcing fibers 10 sandwiched between metal matrices 12 and comprising a joined end part 11 in the longitudinal direction of reinforcing fibers 10 which is joined obliquely at a joining angle of 5 to 60 degrees with respect to the longitudinal direction of reinforcing fibers or more preferably wherein a plurality of metal matrices 11 and a plurality flat formations of reinforcing fibers 10 are lapped each other to form layers of metal matrices and flat formations of reinforcing fibers so that the adjacent upper layers of flat formations of reinforcing fibers and the adjacent lower layers of flat formations of reinforcing fibers to a layer having a joined part of flat formations of reinforcing fibers are continuous and have no joined parts.

3 Claims, 4 Drawing Sheets

| Test specimen end part | Test specimen size | | Tensile strength(N/mm$^2$) |
|---|---|---|---|
| | Width (mm) | Thickness (mm) | |
| No end part | 10.04 | 1.63 | 1609 |
| Perpendicular cut end part (inner layer) | 9.98 | 1.60 | 1517 |
| Perpendicular cut end part (outer layer) | 10.01 | 1.57 | 1292 |
| Obliquely cut end part (inner layer) *1 | 10.02 | 1.62 | 1842 |
| Obliquely cut end part (outer layer) *1 | 10.02 | 1.63 | 1610 |

*1: End part is cut at an angle of 45 degrees

METAL MATRIX COMPOSITE

BACKGROUND OF THE INVENTION

1. Field of the Invention

The present invention relates to a composite formed by including metal matrix such as titan or titan alloy with reinforcing fiber such as carbon fiber, more particularly to a composite in which the reinforcing fibers have end parts or to a composite having joint parts.

2. Description of the Related Art

Heretofore, composites formed by combining plural materials have been used widely. Composites are used for parts or members used under particularly severe condition since a composite having characteristics appropriate for a specific use can fabricate by selection of materials, compositions or methods of processing. Metal matrix composites such as titan matrix composite (TMC) have been intensively studied and developed for parts requiring high specific strength and high specific rigidity. The composites are reinforced in such a way that reinforced materials typified by ceramic fibers such as silicon carbide or alumina fiber are mixed with metal matrices comprising metals or metal alloys.

Forming preform when composing each of raw materials is the particularly important process in fabrication of the composite. The following four ways are usually employed.

① A way comprising aligning reinforcing fibers in one direction, fixing the aligned fibers with organic binder or the like and sandwiching the bound fibers between metal matrices.

② A way comprising aligning reinforcing fibers in one direction and fixing the aligned fibers by weaving with metal (metal alloy) foil.

③ Away comprising vapor-depositing metal matrix on to the surface of reinforcing fibers by physical vapor deposition (PVD method).

④ A way comprising winding reinforcing fibers on a drum and fixing the reinforcing fibers by thermal-spraying metal (metal alloy) on the surface thereof.

Above all, the way of composing to form preform by sandwiching bundles of reinforcing fibers between metal matrices where reinforcing fibers have been agglomerated together in advance such as a way of fixing reinforcing fibers with organic binder or a way of fixing reinforcing fibers by weaving with metal (metal alloy) foil is widely employed because of inexpensive cost and simple processing.

For example, when fabricating a tape type composite, flat cloths of reinforcing fibers such as carbon fibers are sandwiched between tape type continuous metal matrices such as titan or titan alloy to form a preform, which is then hot-pressed. If necessary, the preform is rendered to hot isostatic pressing (hereinafter referred to as HIP) under the condition of high pressure and high temperature in a sealed pressure vessel to form a tape type composite.

Such HIP processing is performed as follows.

The tape type preform is sealed into a HIP pressure vessel and set to an initial pressure and temperature. In case of Ti-4.5Al-3V-2Fe-2Mo alloy, an initial pressure is approximately 30 kg/cm$^2$ and temperature is approximately 400° C. The process is followed by gradual heating until not lower than the temperature where stress decreases to cause plastic deformation that is a high temperature region of HIP processing temperature to keep. An appropriate temperature in case of Ti-4.5Al-3V-2Fe-2Mo alloy is approximately 750–850° C., or more preferably approximately 775° C.

After heating to a predetermined temperature, pressure is increased to approximately 1200 kg/cm$^2$, the condition is kept for about 2 hours and then both of the pressure and temperature are decreased.

An annular composite can be made by HIP processing from the convolved tape type preform thus fabricated.

However, in case of the continuous tape type preform, there are indispensably end parts of reinforcing fibers arising when processing, for example, removing defective parts or when cutting in a predetermined length. Treatment of thus arisen end parts has been a problem. Conventionally, as shown in FIG. 5, vertical cut ends 15 of the end parts of reinforcing fibers are joined together; the joined part is sandwiched between upper metal matrix and lower metal matrix and processed by means of hot-press or HIP to fabricate a composite 16.

In thus formed composite, a part where reinforcing fibers sandwiched between metal matrices is vertically cut, that is a joined part of reinforcing fibers is extremely low in strength. As a result, the composite has low strength and poor reliability as a whole so that it is difficult to supply stable and high performance material.

Especially when an annular composite, which is often applied to aircraft engine, is fabricated by HIP process from the tape type preform, the cutting ends 15 in the annular part involve the risk of rupture of the material itself through generation of cracks owning to repeated stress which is loaded to the composite even if the stress is under the elemental strength of the composite 16.

SUMMARY OF THE INVENTION

In view of the need to solve the prior problems, the present invention has an object to provide a metal matrix composite having stable performance without extremely weak portions and capable of assuring strength with a simple structure.

To solve the problems, in one aspect of the present invention, a metal matrix composite formed by hot-pressing or hot-isostatic-pressing a flat formation of reinforcing fibers sandwiched between metal matrices comprises a joined end part in the longitudinal direction of reinforcing fibers which is joined obliquely at an aspect ratio within the approximate range of 2:1 to 1:10 on the basis of the direction of the width of reinforcing fibers to the longitudinal direction of reinforcing fibers.

In another aspect of the present invention, a metal matrix composite formed by hot-pressing or hot-isostatic-pressing a flat formation of reinforcing fibers sandwiched between metal matrices comprises a joined end part in the longitudinal direction of reinforcing fibers which is joined obliquely at a joining angle of 5 to 60 degrees with respect to the longitudinal direction of reinforcing fibers.

The present invention provides a composite which is composed in such a manner that the end part of reinforcing fibers are cut in an oblique direction, the obliquely cut faces are joined together, the joined part of reinforcing fibers is sandwiched between metal matrices, and thus integrated part of metal sandwiched fibers is hot-pressed or hot-isostatic-pressed. Thus, a composite having stable performance and reliability, which does not give rise to lowering of strength against the stress perpendicular to the longitudinal direction of fibers can be provided.

The metal matrix composite according to the invention can be fabricated with reduced cost because the composite have extremely simple structure.

The joining angle is preferably 5 to 60 degrees or more preferably 5 to 45 degrees or the aspect ratio is preferably in the approximate range of 2:1 to 1:10.

That is because if the ratio difference of the aspect ratio is larger than about 1:10 or the joining angle is less than about 5 degrees, the strength of the reinforcing fibers in themselves lowers, if the ratio difference of the aspect ratio is smaller than about 2:1 or the joining angle is greater than about 60 degrees, the overlap length of the joined part is so short that the fact causes lowering of strength of the reinforcing fibers.

According to yet another aspect of the present invention, in a metal matrix composite formed by hot-pressing or hot-isostatic-pressing a flat formation of reinforcing fibers sandwiched between metal matrices, a plurality of metal matrices and a plurality flat formations of reinforcing fibers are lapped each other to form layers of metal matrices and flat formations of reinforcing fibers so that the adjacent upper layers of flat formations of reinforcing fibers and the adjacent lower layers of flat formations of reinforcing fibers to a layer having a joined part of flat formations of reinforcing fibers are continuous and have no joined parts.

For example, when a joined part of reinforcing fibers comes to the surface part of the composite, cracks tend to occur from out side where stress is easily transferred. The joined part position should be a middle position with respect to the lapping direction so as to be protected by the upper and lower layers of continuous reinforcing fibers, preventing from lowering of strength. Thus, more reliable quality assurance is possible.

DETAILED DESCRIPTION OF PREFERRED EMBODIMENTS

The invention will now be described below in detail by way of example with reference to the accompanying drawings. It should be understood, however, that the description herein of specific embodiments such as to the dimensions, the kinds of material, the configurations and the relative disposals of the elemental parts is not intended to limit the invention to the particular forms disclosed but the intention is to disclose for the sake of example unless otherwise specifically described.

Figure 1A:
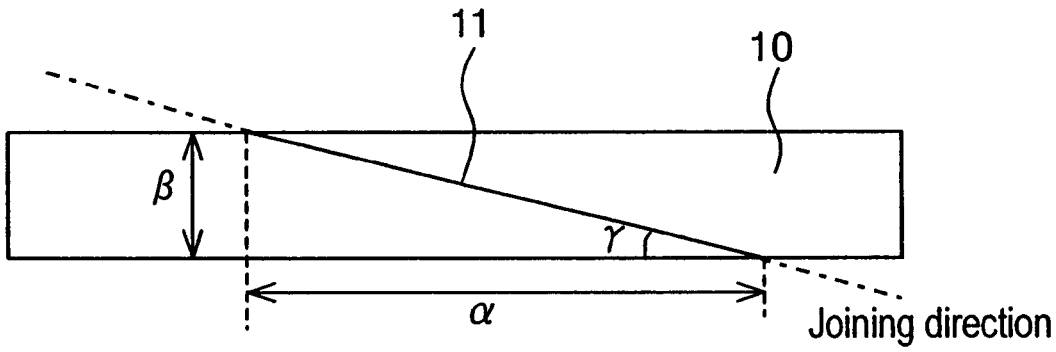
FIGS. 1(*a*) and 1(*b*) show a schematic side view of composite material tape having an obliquely joined ends part according to an embodiment of the present invention.
Figure 1B:
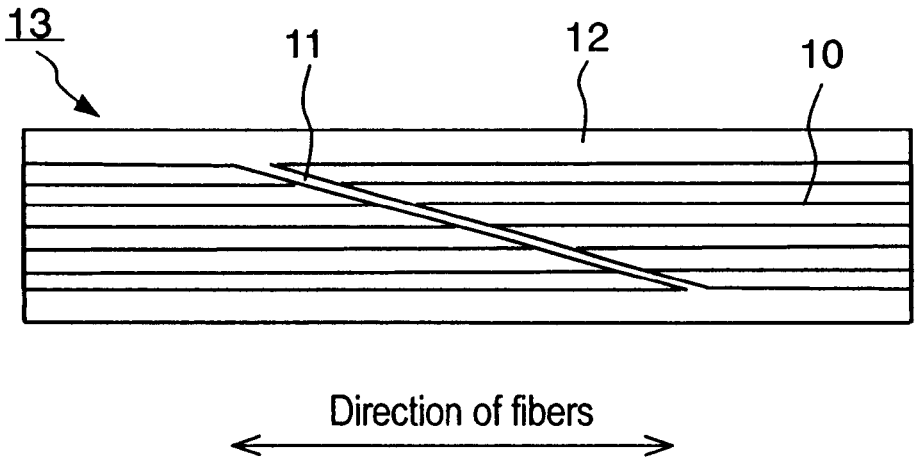
Figure 2A:
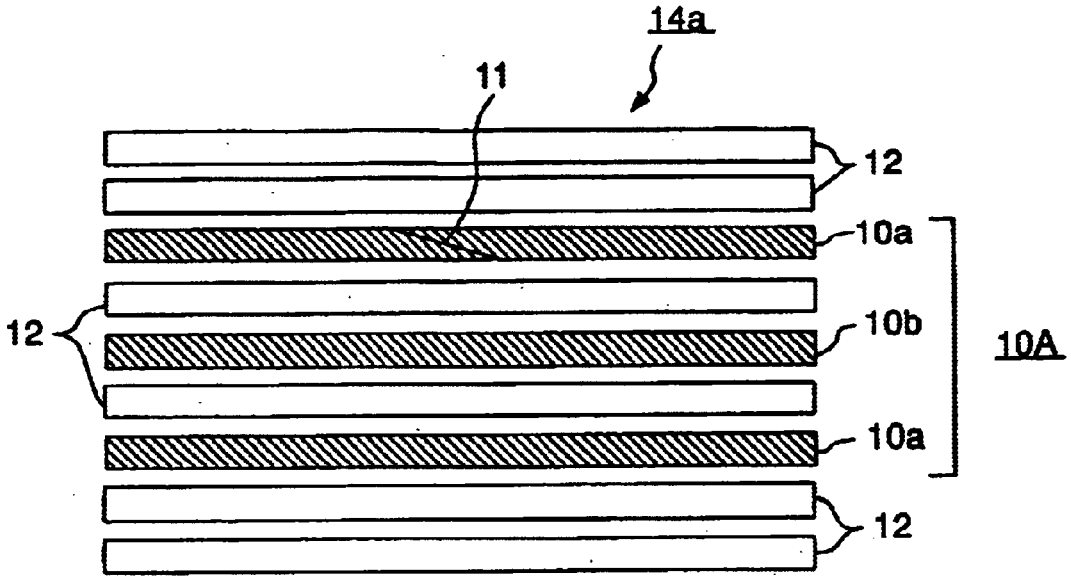
FIGS. 2(*a*) and 2(*b*) show a schematic drawing showing lapping structure of composite material tape according to an embodiment of the present invention.
Figure 2B:
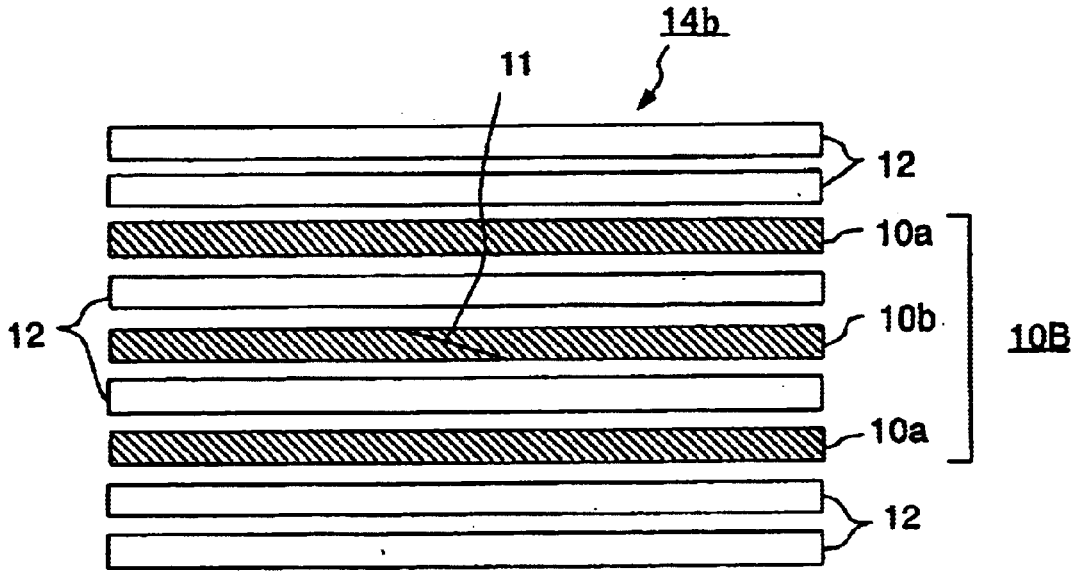
Figures 3, 4:
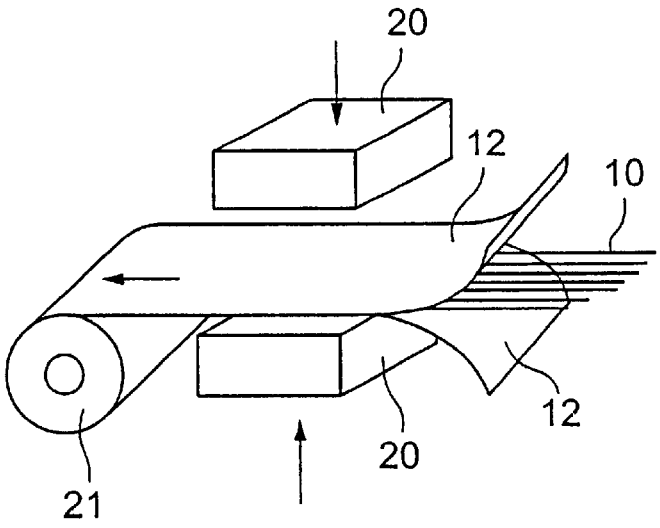
FIG. 3 is a table showing tensile strength of an obliquely cutting end part, of perpendicularly cutting end part and of no end part of composite material tape according to an embodiment of the present invention.
FIG. 4 is a schematic perspective view showing heat press process of composite material tape.
Figure 5:
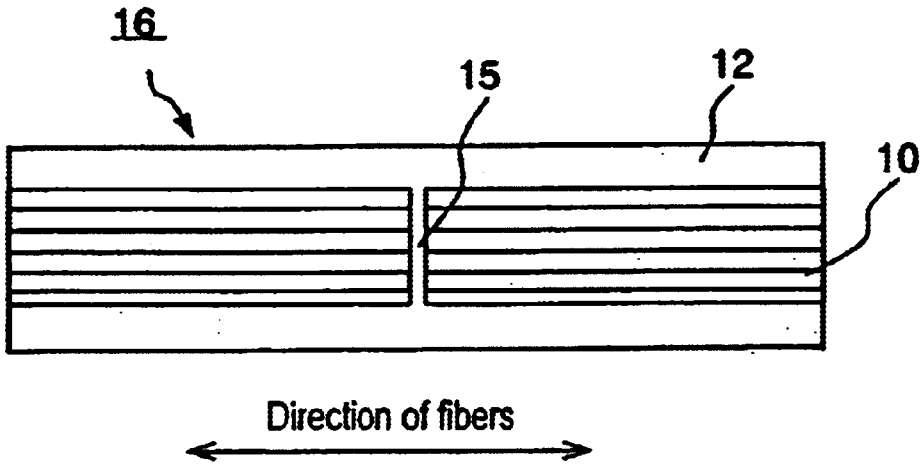
FIG. 5 PRIOR ART
FIG. 5 is a schematic side view of a joined end part of conventional composite material tape.

FIG. 1 is a schematic side view of composite material tape having an oblique joint ends part according to an embodiment of the present invention. FIG. 2 is a schematic drawing showing lapping structure of composite material tape according to an embodiment of the present invention. FIG. 3 is a table showing tensile strength of an obliquely cutting end part, of perpendicularly cutting end part and of no end part of composite material tape according to an embodiment of the present invention. FIG. 4 is a schematic perspective view showing heat press process of composite material tape. FIG. 5 is a schematic side view of a joined end part of conventional composite material tape.

In FIG. 1, a flat formation of reinforcing fibers 10 is formed by weaving reinforcing fibers consisting essentially of silicon carbide and is aggregate of discontinuous reinforcing fibers after removal of defective parts or after fabricating process. Meanwhile, titan alloy foil 12 is formed to continuous tape form.

Though in the embodiment of the present invention, an example in which titan alloy is used as matrix and silicon carbide is used as reinforcing fiber is explained, material used is not particularly restricted. Such metal or metal alloy as aluminum, stainless can be used instead of titan alloy foil 12 and such fiber as ceramic fiber including alumina fiber can be used instead of silicon carbide fiber. Any thing such as a flat formation formed by aligning silicon carbide fibers in one direction and fixing with organic binder will do when it comes to a flat formation of reinforcing fibers instead of a flat formation of reinforcing fibers 10.

As shown in FIG. 1(*b*), the flat formation of reinforcing fibers 10 is processed to a tape type preform 13 in such a manner that obliquely cut discontinuous part of reinforcing fibers is sandwiched between titan alloy foils 12.

A joined part 11 of the flat formation of reinforcing fibers 10 is formed as shown in FIG. 1(*a*), so that an aspect ratio $\alpha:\beta$ of the length $\alpha$ in the longitudinal direction of reinforcing fibers to the length $\beta$ in the direction of width of reinforcing fibers is approximately 2:1 to 1:10 or a joining angle $\gamma$ with respect to the longitudinal direction of reinforcing fibers is to be approximately 5–60 degrees.

Hereby, a composite having stable performance and reliability, which scarcely give rise to lowering of strength against the stress perpendicular to the longitudinal direction of fibers can be provided.

A continuous composite material tape is fabricated by sandwiching thus formed flat formation of reinforcing fibers 10, as shown in FIG. 4, between the titan alloy foils 12, pressing vertically with a hot press 20 to compose, and taking up to a roll 21.

FIG. 2(*a*) and FIG. 2(*b*) show composite material tapes 14*a*, 14*b* fabricated by lapping a plurality of flat formations of reinforcing fibers 10 and a plurality of titan alloy foils 12. The table of FIG. 3 shows a measured results of the tensile strength of the composite material tapes 14*a*, 14*b*.

FIG. 2(*a*) shows a composite material tape 14*a* having a joined part 11 in the flat formation of reinforcing fibers 10*a* which is the nearest to the surface out of a plurality of flat formations of reinforcing fibers 10A.

FIG. 2(*b*) shows a composite material tape 14*b* having a joined part 11 in the flat formation of reinforcing fibers 10*b* which is the inner part in the direction of lapping, i.e. in the direction of width of the composite material out of a plurality of flat formations of reinforcing fibers 10B so that the outer flat formation of reinforcing fibers 10*a* in the upper and lower direction is a continuous without joined parts which is the composite material tape 14*b*.

These composite material are hot-pressed, set to a predetermined form, and applied HIP processing.

The table of FIG. 3 shows a measured results of the tensile strength of a composite material having a obliquely joined ends part shown in FIGS. 2 (*a*) and (*b*), of a composite material having no obliquely joined ends part, and of a composite material having a vertically joined ends part, each fabricated under the same condition as the former.

As these composites processed under the same condition, the filling factor of reinforcing fibers that is contained in the composite materials, the number and the pattern of lapped flat formations of reinforcing fibers, the number of lapped titan alloy foils, or the width and thickness of composite materials is the same respectively. As the measurement is carried out under the same environmental condition, temperature and pressure condition of measurement is the same.

The test specimen of composite material used in such measurement is 10 mm wide, 1.6 mm thick. A tensile strength of the specimen is measured in the longitudinal direction of the fibers at atmospheric pressure and ordinary temperature (about 24° C.).

While the observed tensile strength of a composite material having no end part (6 ply of preforms of reinforcing fibers) is 1609 $N/mm^2$, the observed tensile strength of a composite material having a vertical end part (7 ply of preforms of reinforcing fibers) at the inner part is 1517 $N/mm^2$ though more ply of preforms of reinforcing fibers should have strengthen the composite and yet the observed tensile strength of a composite material having a vertical end part (6 ply of preforms of reinforcing fibers) at the outer part is as weak as 1292 $N/mm^2$.

A composite material 14*b* (7 ply) having a obliquely joined end part 11 of a joining angle of 45 degrees with respect to the longitudinal direction of reinforcing fibers at the inner part, as shown in FIG. 2(*b*), shows a tensile strength of 1842 $N/mm^2$, being stronger than the composite material having no end part because of one increasing ply.

A composite material 14*a* (6 ply) having a obliquely joined end part 11 of a joining angle of 45 degrees at the outer part, as shown in FIG. 2 (*a*), shows a tensile strength of 1610 $N/mm^2$, being inferior to the composite material 14*b* having joined end part at the inner part with regard to its strength but bringing about no significant lowering of strength.

Thus, the obliquely joined end part 11 is nearly as strong as the no joined end part; thereby the composite material has no part that gives rise to lowering of strength, which results in securing reliability of the material. As particularly apparent from the aforementioned result of measurement, a composite material having increased reliability can be provided when the joined part position is a middle position with respect to the lapping direction so as to be protected by the upper and lower layers of continuous reinforcing fibers, preventing from lowering of strength.

In addition to the aggregates of reinforcing fibers such as those formed by fixing with binder or by weaving, as described in the embodiment, the feature of the present invention can be applied when a plurality of formation formed preforms made by hot-pressing reinforcing fibers vapor-deposited with metal matrix are further lapped and hot-isostaic-pressed to fabricate a composite material. A composite material without lowering of strength can be provided if the preforms are lapped in such a manner that joined parts of the preformes are oblique.

As described above, according to the present invention, a metal matrix composite having stable performance without extremely lowering the strength against the stress perpendicular to the longitudinal direction of fibers and capable of assuring strength with a simple structure can be provide.

Further, the strength of the composite material is not lowered because of joining with an aspect ratio of within an approximate range of 2:1 to 1:10 or with a joining angle of 5 to 60 degrees and by lapping with enough overlap of joined parts.

Yet further, the joined part position is a middle position with respect to the lapping direction so as to be protected by the upper and lower layers of continuous reinforcing fibers, preventing from lowering of strength and thus, more reliable quality assurance being possible.

And the metal matrix composite according to the invention can be fabricated with reduced cost because the composite has extremely simple structure.

What is claimed:

1. A metal matrix composite formed by hot-pressing or hot-isostatic-pressing a flat formation of reinforcing fibers sandwiched between metal matrices comprising a joined end part in the longitudinal direction of reinforcing fibers which is joined obliquely at an aspect ratio within the approximate range of 2:1 to 1:10 on the basis of the direction of the width of reinforcing fibers to the longitudinal direction of reinforcing fibers.

2. A metal matrix composite formed by hot-pressing or hot-isostatic-pressing a flat formation of reinforcing fibers sandwiched between metal matrices comprising a joined end part in the longitudinal direction of reinforcing fibers which is joined obliquely at a joining angle of about 5 to 60 degrees with respect to the longitudinal direction of reinforcing fibers.

3. A metal matrix composite formed by hot-pressing or hot-isostatic-pressing a flat formation of reinforcing fibers sandwiched between metal matrices according to claims 1 or 2, wherein a plurality of metal matrices and a plurality flat formations of reinforcing fibers are lapped each other to form layers of metal matrices and flat formations of reinforcing fibers so that the adjacent upper layers of flat formations of reinforcing fibers and the adjacent lower layers of flat formations of reinforcing fibers to a layer having a joined part of flat formations of reinforcing fibers are continuous and have no joined parts.

* * * * *